US006328107B1

(12) United States Patent
Maus

(10) Patent No.: US 6,328,107 B1
(45) Date of Patent: Dec. 11, 2001

(54) METHOD FOR INSTALLING A WELL CASING INTO A SUBSEA WELL BEING DRILLED WITH A DUAL DENSITY DRILLING SYSTEM

(75) Inventor: L. Donald Maus, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/626,880

(22) Filed: Jul. 27, 2000

Related U.S. Application Data

(60) Provisional application No. 60/154,572, filed on Sep. 17, 1999.

(51) Int. Cl.[7] ..... E21B 7/12; E21B 17/01; E21B 21/08

(52) U.S. Cl. ..... 166/335; 166/344; 166/381; 175/5; 175/7

(58) Field of Search ..... 166/335, 339, 166/344, 367, 380, 381; 175/5, 7–10, 38, 40, 48, 50; 405/224.2

(56) References Cited

U.S. PATENT DOCUMENTS

| | | | | |
|---|---|---|---|---|
| 1,619,521 | * | 3/1927 | Lawlor et al. | 166/381 X |
| 1,812,986 | * | 7/1931 | Ryan | 166/380 X |
| 2,173,033 | * | 9/1939 | Armentrout et al. | 166/381 X |
| 3,283,815 | * | 11/1966 | Allen et al. | 166/381 X |
| 3,353,599 | * | 11/1967 | Swift | 166/381 X |
| 3,603,409 | | 9/1971 | Watkins | 175/7 |
| 3,754,607 | * | 8/1973 | Van Daalen | 175/7 |
| 3,815,673 | | 6/1974 | Bruce et al. . | |
| 3,911,740 | | 10/1975 | Calhoun | 73/153 |
| 3,976,148 | | 8/1976 | Maus et al. | 175/7 |
| 4,046,191 | | 9/1977 | Neath . | |
| 4,081,039 | * | 3/1978 | Wardlaw | 175/7 |
| 4,091,881 | | 5/1978 | Maus | 175/7 |
| 4,099,583 | | 7/1978 | Maus | 175/7 |
| 4,210,208 | | 7/1980 | Shanks | 166/352 |
| 4,216,834 | | 8/1980 | Wardlaw | 175/7 |

(List continued on next page.)

FOREIGN PATENT DOCUMENTS

| | | | | |
|---|---|---|---|---|
| 2257449 | * | 1/1993 | (GB) | 166/335 X |
| WO 98/16716 | | 4/1998 | (WO) | E21B/21/00 |
| WO 99/18327 | | 4/1999 | (WO) | E21B/21/08 |

OTHER PUBLICATIONS

Lopes, C. A. and Bourgoyne, A. T., Jr. , "Feasibility Study of a Dual Density Mud System For Deep Water Drilling Operations", OTC 8465, Offshore Technology Conference, May 5–8, 1997; pp. 257–266.

Lopes, C. A., "Feasibility Study on the Reduction of Hydrostatic Pressure in a Deep Water Riser Using a Gas–Lift Method", Ph.D. dissertation submitted to Louisiana State University, May 1997.

Maus, L. D., et al "Instrumentation Requirements for Kick Detection in Deep Water", Journal of Petroleum Technology Aug. 1979, pp. 1029–1034.

(List continued on next page.)

*Primary Examiner*—David Bagnell
*Assistant Examiner*—Jong-Suk Lee
(74) *Attorney, Agent, or Firm*—Kelly A. Morgan

(57) ABSTRACT

A method for controlling the pressure at the base of a gas-lifted riser during casing installation is disclosed. Prior to casing installation, drilling fluid is displaced from the riser and the riser is filled with seawater. During casing installation, the riser base pressure is monitored, and the height of seawater in the riser is adjusted to compensate for increases in the riser base pressure. The riser base pressure is thereby maintained substantially equal to the seawater pressure at the base of the drilling riser throughout installation of the casing.

14 Claims, 5 Drawing Sheets

U.S. PATENT DOCUMENTS

| | | | | |
|---|---|---|---|---|
| 4,220,207 | | 9/1980 | Allen | 166/367 |
| 4,291,772 | | 9/1981 | Beynet | 175/5 |
| 4,440,239 | | 4/1984 | Evans | 175/5 |
| 4,813,495 | | 3/1989 | Leach | 175/6 |
| 4,879,654 | | 11/1989 | Bruce | 364/422 |
| 5,006,845 | | 4/1991 | Calcar et al. | 340/853 |
| 5,184,686 | * | 2/1993 | Gonzalez | 175/5 |
| 5,249,635 | | 10/1993 | King et al. | 175/48 |
| 5,873,420 | | 2/1999 | Gearhart | 175/25 |
| 6,102,119 | * | 8/2000 | Raines | 166/381 X |

OTHER PUBLICATIONS

Maus, L. D., et al "Sensitive Delta–Flow Method Detects Kicks or Lost Returns", Oil & Gas Journal, Aug. 20, 1979; pp. 125–132.

LeBlanc, L., "Riserless Drilling JIP Moving to Second Phase Development", Offshore, Dec. 1997; pp. 31–34.

Shaughnessy, J. M. and Herrmann, R. P., "Concentric Riser Will Reduce Mud Weight Margins, Improve Gas–Handling Safety", Oil & Gas Journal, Nov. 2, 1998; pp. 54–62.

Choe, Jonggeun, "Analysis of Riserless Drilling System and Well Control With a Windows–Based User–Interactive Program", SPE, Texas A&M University; pp. 1–13., Undated.

Choe, Jonggeun, "Analysis of Riserless Drilling and Well–Control Hydraulics", SPE Drill & Completion (14) Mar. 1, 1999; pp. 71–81.

Choe, Jonggeun, "Well Control Aspects of Riserless Drilling", SPE 49058, Sep. 1998; pp. 355–366.

Nessa, D. O. et al, "Offshore Underbalanced Drilling System Could Revive Field Developments", World Oil, Jul. 1997; pp. 61–66.

Nessa, D. O. et al, "Offshore Underbalanced Drilling System Could Revive Field Developments", Part 2., World Oil, Oct. 1997; pp. 83–88.

Sangesland, S., "Riser Lift Pump for Deep Water Drilling", IADC/SPE 47821, Sep. 1998.; pp. 299–309.

* cited by examiner

METHOD FOR INSTALLING A WELL CASING INTO A SUBSEA WELL BEING DRILLED WITH A DUAL DENSITY DRILLING SYSTEM

This application claims the benefit of U.S. Provisional Application No. 60/154,572 filed Sep. 17, 1999.

FIELD OF THE INVENTION

This invention relates generally to offshore well drilling operations. More particularly, the invention pertains to installing a well casing into an offshore subsea well using a dual density drilling system. Specifically, the invention is a method for maintaining the pressure at the base of the marine drilling riser approximately equal to seawater pressure during casing installation.

BACKGROUND OF THE INVENTION

In recent years the search for offshore deposits of crude oil and natural gas has been moving into progressively deeper waters. In very deep waters it is common practice to conduct drilling operations from floating vessels or platforms. The floating vessel or platform is positioned over the subsea wellsite and is equipped with a drilling rig and associated drilling equipment. To conduct drilling operations from a floating vessel or platform, a large diameter pipe known as a"marine drilling riser" or"drilling riser" is typically employed. The drilling riser extends from above the surface of the body of water downwardly to a wellhead located on the floor of the body of water. The drilling riser serves to guide the drill string into the well and provides a return conduit for circulating drilling fluids (also known as"drilling mud" or simply "mud").

An important function performed by the circulating drilling fluids is well control. The column of drilling fluid contained within the well bore and the drilling riser exerts hydrostatic pressure on the subsurface formation which overcomes formation pore pressure and prevents the influx of formation fluids into the well bore, a condition known as a"kick." However, if the column of drilling fluid exerts excessive hydrostatic pressure, another problem can occur, i.e., the pressure of the drilling fluid can exceed the natural fracture pressure of one or more of the exposed subsurface formations. Should this occur, the hydrostatic pressure of the drilling fluid could initiate and propagate a fracture in the formation, resulting in drilling fluid loss to the formation, a condition known as"lost circulation". Excessive fluid loss to one formation can result in loss of well control in other formations being drilled, which greatly increases the risk of a blowout.

For a conventional offshore drilling system, in which the mud in the well and the drilling riser constitute a continuous fluid column from the bottom of the well to the drilling rig at the surface of the body of water, it is increasingly difficult as water depth increases to maintain the pressure in the borehole intermediate the pore pressure and fracture pressure of the exposed formations. This pressure problem limits the length of allowable open borehole and requires frequent installation of protective casing strings, which in turn, results in longer times and higher costs to drill the well. One solution to this difficulty is to maintain the mud pressure at the wellhead (i.e., at the elevation of the floor of the body of water) approximately equal to that of the surrounding water, thus effectively eliminating the influence of the overlying body of water.

Various methods for accomplishing this objective are known in the art, including mechanically pumping the drilling mud from the seafloor and injection of lower density gases, liquids or solids into the drilling mud to decrease the effective density of the mud column to that of seawater. Since all such methods create the equivalent of a column of seawater in the drilling riser that has a density different from that of the drilling mud in the well, they are known as"dual density" systems. One such system involves injecting a gas ("lift gas") such as nitrogen into the lower end of the drilling riser. When lift gas is injected into the drilling riser, it intermingles with the returning drilling fluid and reduces the equivalent density of the column of drilling fluid in the riser to that of seawater. The column of drilling fluid in the well below the lift gas injection point does not contain lift gas and, accordingly, is denser than the drilling fluid in the riser.

Typically with a gas-lifted drilling riser, the pressure at the top of the riser is maintained at an elevated level (e.g., 250 psig). However, it is often necessary to intermittently shut down the gas lift system and de-pressure the drilling riser, particularly when the returns are lifted in the same conduit which is used to guide drilling tools, casing and other devices from the surface into the subsea well. Although it is practical and desirable to protect the well from variations in riser base pressure ($p_{rb}$) during the transition from gas lifting by closing one or more subsea blowout preventors (BOPs), it is important that riser base pressure ($p_{rb}$) ultimately return to seawater pressure if any portion of the subsea well is uncased. As described further below, this is particularly true if it will be necessary to open the BOP prior to resuming gas lift, such as is often the case when installing well casing.

One way to achieve the objective of maintaining seawater pressure ($p_{sw}$) at the base of the riser when gas lifting is shut down is to cease injection of gas, pump seawater into the base of the riser to replace the gas-lifted mud and de-pressure the riser. This results in the riser being open to the atmosphere at the top and filled with quiescent seawater. This is a desirable condition to create prior to installing casing. The well below the riser remains full of the original, higher density, drilling mud. As casing is inserted into the riser, an equal volume of seawater will be displaced out the top of the riser and the internal pressure at the base of the riser ($p_{rb}$) will remain equal to that of the external seawater ($p_{sw}$). However, once the bottom of the casing string enters the open well, the higher density drilling mud will be displaced into the bottom of the riser while an equal volume of seawater is displaced out of the top of the riser. Progressively, the seawater in the riser will be replaced by higher density drilling mud and the hydrostatic pressure ($p_{rb}$) at the base of the riser and in the well will increase. The increased pressure in the well opposite exposed formations may exceed the fracture pressure of the rock, resulting in the well control problem described above.

One approach to addressing this problem is to open a valve at the base of the drilling riser and let excess drilling mud discharge into the sea. However, this approach presents potential pollution hazards and can be expensive since large volumes of drilling mud will be lost. Another approach is to pump the excess drilling mud back to the surface through a separate conduit. While feasible, this requires a relatively large pump at the seafloor if the mud evacuation rate is high enough to keep pace with the normal rate at which casing is made up and run into the riser and well.

From the foregoing, it can be seen that there is a need for an improved method for installing a well casing into a subsea well being drilled with a gas-lifted or other dual density drilling system. Such a method should be capable of maintaining the riser base pressure ($p_{rb}$) relatively constant during the entire process of casing installation. The present invention satisfies this need.

SUMMARY OF THE INVENTION

A method is disclosed for installing a well casing through a drilling riser into a subsea well being drilled with a dual density drilling system. The drilling riser contains seawater and extends from above the surface of the body of water downwardly to a subsea wellhead. The well casing is lowered through the drilling riser to the subsea wellhead and the displaced seawater flows out of the top of the drilling riser. The well casing is then lowered through the subsea wellhead into the well and displaced drilling fluid flows upwardly into the drilling riser. The riser base pressure ($p_{rb}$) is monitored as the well casing is lowered into the well. Seawater is evacuated from the upper part of the drilling riser, using a subsea pump, to compensate for increases in the riser base pressure ($p_{rb}$) arising from the displaced drilling fluid so as to maintain the riser base pressure approximately equal to the ambient seawater pressure at that depth.

BRIEF DESCRIPTION OF THE DRAWINGS

The present invention and its advantages may be better understood by referring to the detailed description set forth below and the attached drawings in which.

The invention will be described in connection with its preferred embodiments. More specifically, the present invention is described in relation to a drilling system employing a gas-lifted drilling riser; however it is applicable to all dual-density systems. To the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

DETAILED DESCRIPTION OF THE INVENTION

Figure 1:
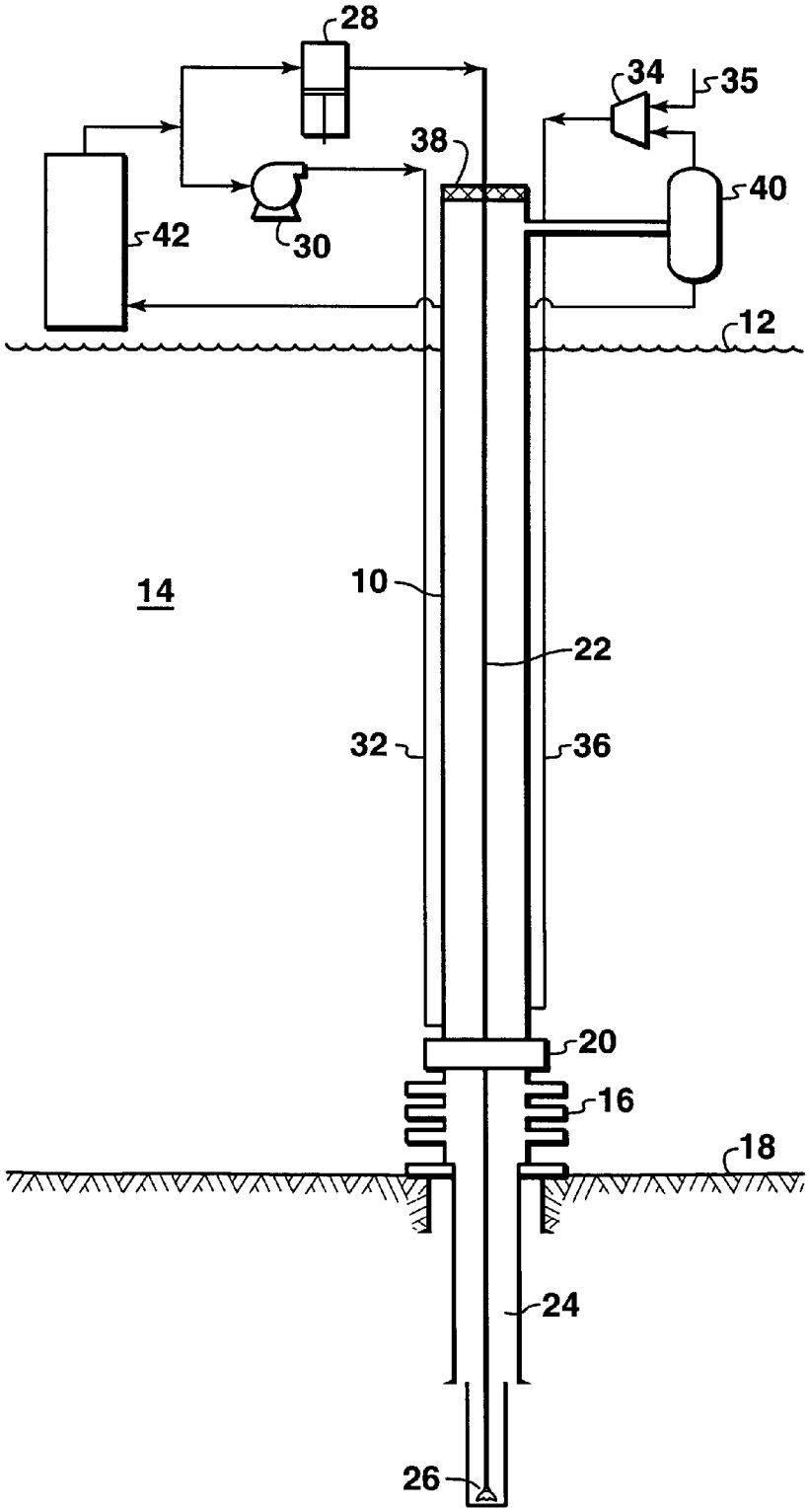
FIG. 1 illustrates a general overview of offshore drilling operations using a gas-lifted drilling system.

FIG. 1 provides a general overview of a gas-lifted drilling system consisting of a conventional marine drilling riser 10 extending from a floating vessel or platform (not shown) at the surface 12 of body of water 14 to a blowout preventer (BOP) stack 16 located on the floor 18 of body of water 14. Typically, riser 10 is from about 16 inches to about 24 inches in outer diameter and is made of steel. Riser 10 is attached to BOP stack 16 by a lower marine riser package (LMRP) 20 consisting of: a connector for attaching riser 10 to BOP stack 16, connectors for various auxiliary fluid, electrical, and control lines; and, in many instances, one or more annular BOPs. As in conventional offshore drilling operations, a drill string 22 is suspended from a drilling derrick (not shown) located on the floating vessel or platform. The drill string 22 extends downwardly through drilling riser 10, lower marine riser package 20, BOP stack 16 and into borehole 24. A drill bit 26 is attached to the lower end of drill string 22. A conventional surface mud pump 28 pumps drilling mud down the interior of drill string 22, through nozzles in drill bit 26, and into subsea well 24. The drilling mud returns to the wellhead via the annular space between drill string 22 and the walls of well 24, and then to the surface through the annular space between drill string 22 and riser 10. Also included in a conventional offshore drilling system is a boost mud pump 30 for pumping additional drilling mud down a separate conduit or "boost mud line" 32 attached to riser 10 and injecting this drilling mud into the base of riser 10. This increases the velocity of the upward flow in riser 10 and helps to prevent settling of drill cuttings.

Modifications to the conventional drilling system to provide gas-lifting capability include a source (not shown) of lift gas (preferably, an inert gas such as nitrogen), a compressor 34 to increase the pressure of the lift gas, and a conduit or lift gas injection line 36 to convey the compressed lift gas to the base of riser 10 where it is injected into the stream of drilling mud and drill cuttings returning from the well. Lift gas enters compressor 34 from separator 40 or from the lift gas source through inlet line 35. Following injection of the gas into the riser 10, the mixture of drilling mud, drill cuttings, and lift gas circulates to the top of riser 10 where it is diverted from riser 10 by rotating diverter 38, a device capable of sealing the annulus between the rotating drill string 22 and the riser 10. The mixture then flows to separator 40 (which may comprise a plurality of similar or different separation units) where the lift gas is separated from the drilling mud, drill cuttings, and any formation fluids that may have entered well 24. The separated lift gas is then routed back to compressor 34 for recirculation. Preferably, separator 40 is maintained at a pressure of about 14 to 21 atmospheres to stabilize the multiphase flow in riser 10, reduce flow velocities in the surface components, and minimize compressor horsepower requirements. The mixture of drilling fluid and drill cuttings (and, possibly, formation fluids) is removed from separator 40, reduced to atmospheric pressure, and then routed to conventional drilling mud processing equipment 42 where the drill cuttings are removed and the drilling mud is reconditioned for recirculation into the drill string 22 or boost mud line 32.

Figure 2:
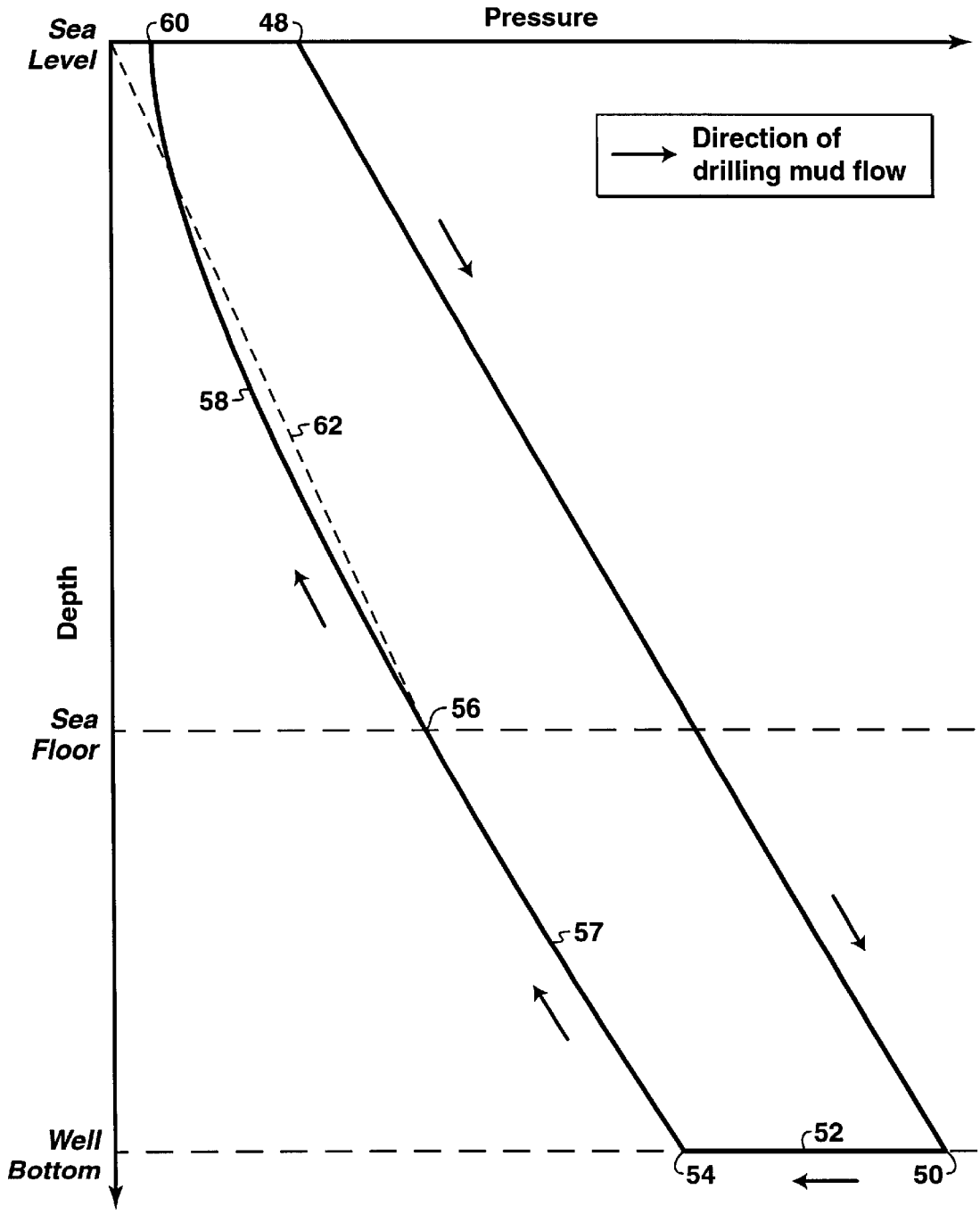
FIG. 2 illustrates the pressure relationships in various parts of a drilling mud circulation system when using a gas-lifted drilling system.

FIG. 2 illustrates the pressure relationships in various parts of the mud circulation system with a gas-lifted drilling riser. Drilling mud is pumped into the system by the surface mud pump at the standpipe pressure 48. The drilling mud increases in pressure as it circulates down the interior of the drill string by virtue of the hydrostatic pressure of the mud column above it (less the flowing frictional pressure drop in the drill string), until it reaches its maximum pressure 50 inside the drill bit. It undergoes a significant pressure drop 52 through the nozzles in the drill bit to the"bottom hole pressure" ($p_{bh}$) 54. Bottom hole pressure 54 and the pressure throughout the portion of the well having exposed formations (i.e., not protected by well casing) must be controlled during the drilling operation to ensure that the formations are not fractured and formation fluids do not enter the well bore. From bottom hole pressure 54, the mud pressure decreases as the mud moves up the well bore, following a gradient 57 determined largely by the density of the mud (including drill cuttings). As illustrated, when it reaches the elevation of the seafloor (i.e., the base of the riser), the pressure 56 of the mud (i.e., the riser base pressure or $p_{rb}$) is substantially the same as the ambient pressure ($p_{sw}$) of the surrounding seawater. At this point, lift gas is injected into the riser and the pressure of the mud-gas mixture follows curve 58 back to the surface where a positive surface pressure 60 (i.e., the riser surface pressure or $p_{rs}$) is maintained. The pressure gradient in the riser approximates that of seawater (represented by dotted line 62) and is different from the pressure gradient 57 in the well bore; hence, this is a "dual density" system. When gas lift is shut down and the riser 10 is filled with seawater, the pressure gradient in riser 10 equals that of seawater 62.

Figures 3A, 3B, 3C, 3D, 3E:
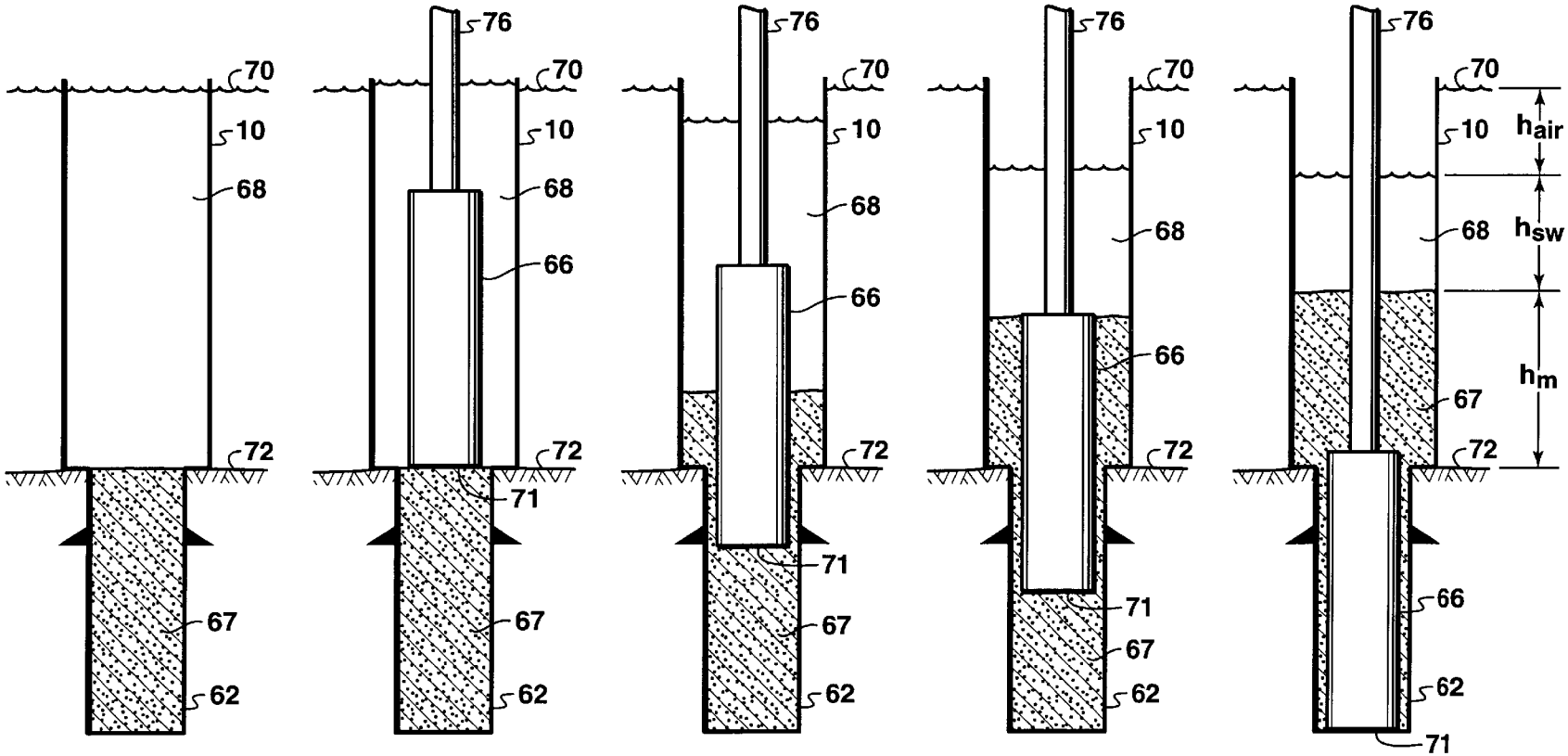
FIG. 3 illustrates the sequence of running casing into a drilling riser and subsea well.

FIG. 3 schematically illustrates the method of the present invention for installing a well casing 66 into a subsea well through drilling riser 10, wherein the subsea well has been drilled with a gas-lift system. Referring now to FIG. 3A, the drilling riser 10 extends from above the surface 70 of the body of water downwardly to a subsea wellhead. Gas lifting has been terminated and riser 10 is filled with seawater 68 and the well below the riser 10 is filled with drilling mud 67. As a result, the internal pressure ($p_{rb}$) at the base of the riser 10 is equal to the external seawater pressure ($p_{sw}$).

There are various methods to fill the riser 10 with seawater 68: One such method is to pump seawater 68 into the base of the riser 10 (perhaps using the mud boost line 32 (which, as illustrated in FIG. 1 is typically installed on drilling risers 10) and displacing the drilling fluid or mud column out of the drilling riser 10. A viscous spacer fluid, such as typically used in casing cementing operations, may be pumped ahead of the seawater to prevent or minimize the mixing of the mud with the lower-density seawater below it. The subsea well is now under control because of the pressure exerted by the column of seawater 68 in the drilling riser 10 and the column of drilling mud 67 in the well.

The object of the invention is to maintain the pressure in the well substantially constant throughout the operation of running the well casing 66 to the bottom of the well 62. This is accomplished by maintaining the pressure ($p_{rb}$) at the base of the riser 10 approximately equal to the ambient seawater pressure ($p_{sw}$). As illustrated in FIG. 3B, once the riser 10 is filled with seawater 68, the well casing 66 can be lowered through the riser 10 to the mudline 72. As the well casing 66 is run into the drilling riser 10, it displaces seawater 68. Because the displaced seawater 68 can either spill out the top of the riser 10 or through an open valve (not shown) at the base of the riser 10, the riser 10 base pressure ($p_{rb}$) will remain constant until the shoe (bottom) 71 of the casing 66 reaches the mudline 72.

As illustrated in FIG. 3C, once the well casing 66 has been lowered into the well, drilling fluid 67 which is displaced from the well will flow into the riser 10 to form a column of mud below the column of seawater 68. Comparing FIGS. 3B and 3C, it can be seen that seawater 68 has been evacuated from the drilling riser 10 to compensate for the increase in the height of the mud column in the riser 10 caused by installation of the casing 66. Thus the riser 10 base pressure ($p_{rb}$) is maintained equal to the ambient seawater pressure ($p_{sw}$). As the well casing 66 is lowered into the is well, the riser 10 base pressure ($p_{rb}$) will tend to increase because of the displaced drilling fluid 67. To maintain the riser 10 base pressure ($p_{rb}$) approximately equal to the seawater pressure ($p_{sw}$) at the base of the riser 10, the riser 10 base pressure ($p_{rb}$) will be monitored as the well casing 66 is lowered into the well, and the level of the seawater 68 column will be lowered accordingly.

The height ($h_{sw}$) of the column of seawater 68 necessary to achieve this can be determined according to the following Equation 1.

$$h_{sw}=D-(\rho_m/\rho_{sw})h_m \qquad \text{Equation (1)}$$

Where:

D=sea water depth to the riser base $\rho_m$=density of mud 67 displaced from well $\rho_{sw}$=density of seawater 68

$h_m$=height of column of mud 67 displaced from well

FIG. 3D illustrates the situation when the height of the column of displaced mud 67 has reached the top of the string of well casing 66. From this point, the rate of upward mud displacement decreases since the volume (per unit length) of the pipe 76 being used to lower the casing string 66 is significantly less than that of the casing string 66, which is now fully submerged in mud 67. FIG. 3E depicts the final stage in which the well casing 66 has been lowered as far as intended. At this point, the level of the top of the column of seawater 68 in riser 10 is as low as it will be.

Figure 4:
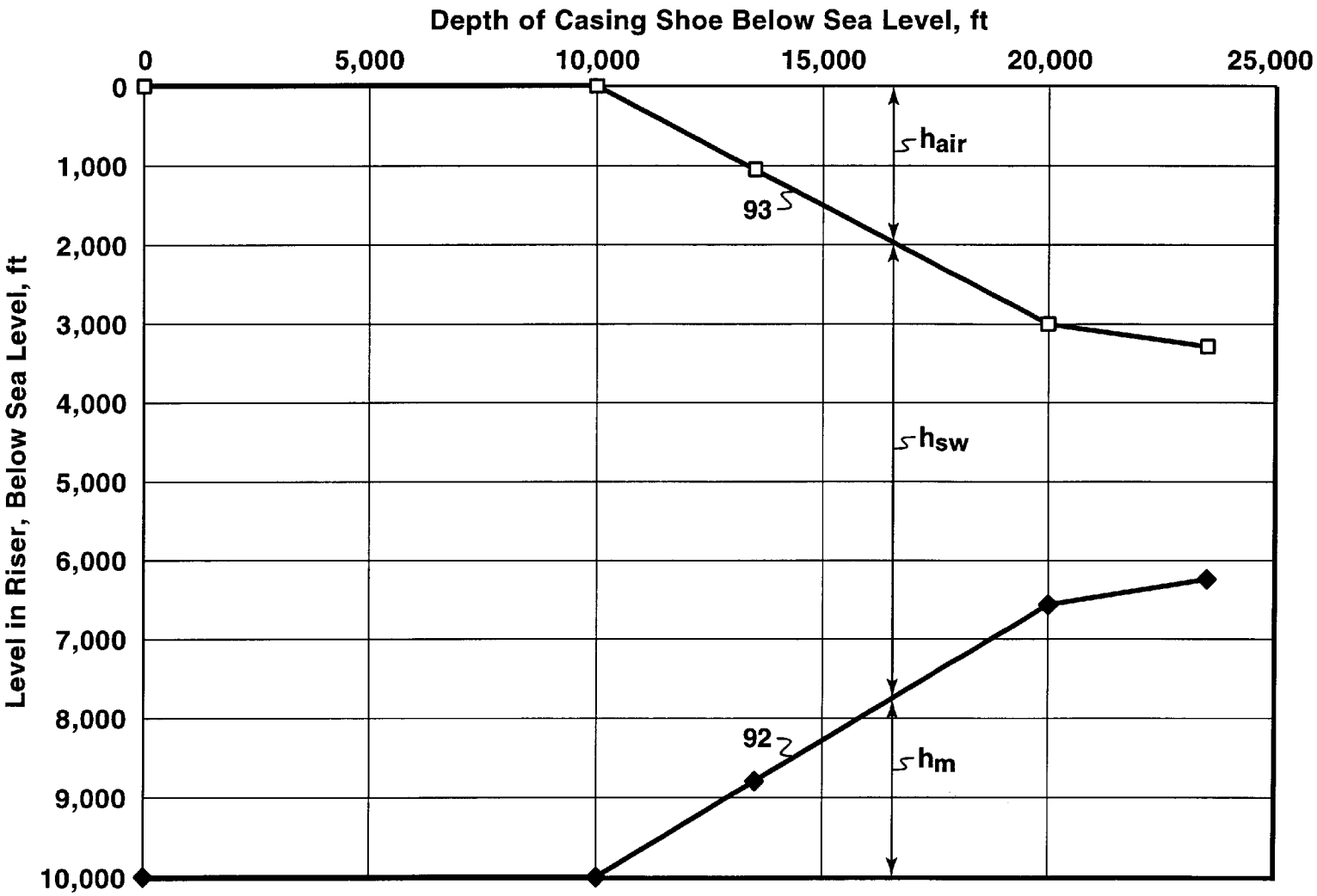
FIG. 4 is a plot of the depths of the top of the mud column and the top of the seawater column as seawater is being evacuated from the drilling riser during casing installation.

FIG. 4 is a plot of the depths below sea level of the top 92 of the mud column 67 and the top 93 of the seawater column 68 in the drilling riser 10 for an example casing 66 installation with a gas-lifted drilling system. In this example, a 13,500 foot string of 9⅝ inch (outer diameter) casing 66 is run closed-ended into a well 62 drilled with gas-lifted returns to 23,500 feet (below sea level) in 10,000 feet of water. The running string is 5½ inch outer diameter drill pipe 76 and the internal diameter of the drilling riser 10 is 19 inches. Until the casing shoe 71 reaches 10,000 feet (water depth), there are no changes in the depths of the tops of the mud and seawater columns. However, as previously described, once the casing shoe 71 enters the well 62, mud 67 equal to the volume within the outside diameter of the casing 66 (9⅝ inches) is displaced upward in the riser 10 while the top 93 of the seawater column 68 is lowered to compensate according to Equation 1. When the casing shoe 71 is 20,036 feet below sea level, the top 92 of the mud column 67 is at the same depth as the top of the casing string 66 and the slope of the displacement curve decreases. When the casing 66 is landed at its intended depth, the top 92 of the mud column 67 is 6,219 feet below sea level and the top of the seawater column 68 is at a depth of 3,295 feet.

When planning well casing 66 installation according to this method, the volume of mud 67 displaced by the well casing 66 and running string 76 into the riser 10 must be less than the volume that would, by itself, exert a pressure at the base of the riser 10 equal to seawater pressure ($p_{sw}$). At this point, there will be no more seawater 68 in the riser 10 with which to compensate. In most instances, it will be possible to start gas-lifting the drilling riser 10 once the top of the casing string 66 is below the rotating diverter 38. From this point forward, evacuation of the drilling riser 10 is not required. A BOP can be closed on the partially run casing string 66 to prevent over-pressuring the well during gas lift startup. It is also possible to limit the length of the casing string 66 (e.g., use a liner instead of a full string of casing) or run well casing 66 open-ended so that the volume of displaced mud is equivalent to only that of the steel being submerged in the mud 67. The drilling riser 10 must also be designed to resist collapse due to the external pressure exerted by the surrounding seawater over the interval above the top of the internal seawater column. Typically, deepwater drilling risers 10 are designed to resist collapse when at least half-empty. This is adequate for this application.

Figure 5:
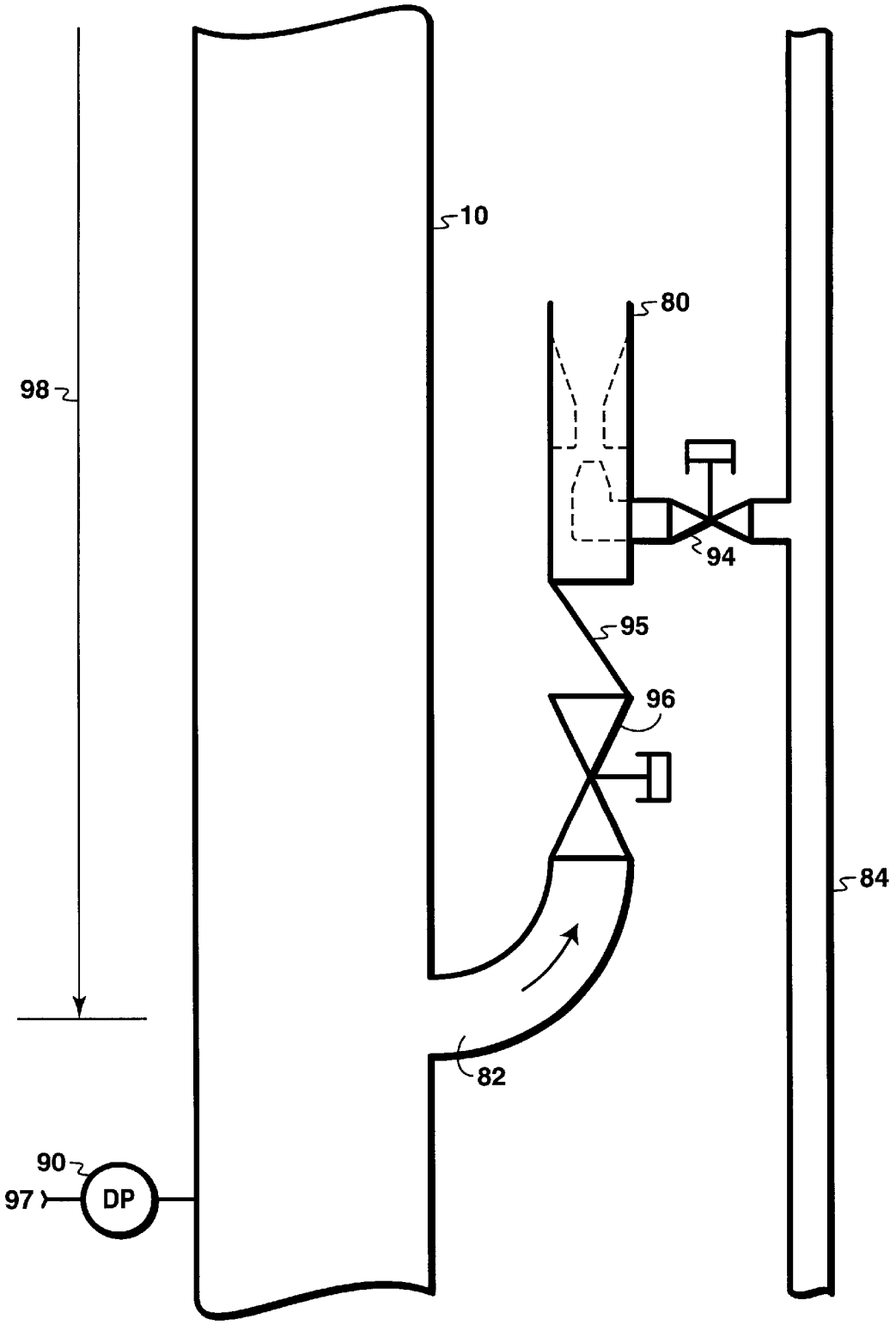
FIG. 5 schematically illustrates the preferred apparatus for evacuating seawater from the drilling riser.

FIG. 5 illustrates the preferred apparatus for evacuating seawater 68 from the riser 10. It consists of a pump 80 with associated piping and valves (e.g., power fluid isolation valve 94; riser evacuation check valve 95; and riser evacuation isolation valve 96) arranged to take suction from the riser 10 and discharge to the sea. The location of the suction connection 82 on the riser 10 may vary depending on water depth, the well drilling plan, and the minimum suction head required by the pump, but it must be located at a sufficient depth 98 to permit evacuation of the riser 10 to the planned minimum (deepest) level. It must also be located above the maximum (shallowest) expected height of the mud column or it will evacuate mud instead of seawater 68. In addition, it is preferable that the suction connection 82 be located such that it will not be possible to inadvertently evacuate the riser 10 to a depth that would cause it to collapse.

The pump 80 can be located at any depth as long as an adequate suction head will be assured at the maximum anticipated seawater evacuation depth. It is preferred, however, that the pump 80 be mounted near the suction connection 82. In FIG. 5 the pump 80 is mounted on the riser 10 slightly above the suction connection 82. This arrangement minimizes the potential for drill cuttings and other solids to accumulate in the suction piping during drilling and possibly plug the pump 80 suction or interfere with valve operation.

It is feasible to use virtually any type of pump 80 that can be adapted to subsea operations and can be attached to the riser 10. It is preferred that the pump 80 be hydraulically powered since the auxiliary lines normally attached to drilling risers 10 (such as the choke line 84, illustrated in FIG. 5) can be used to provide hydraulic power to operate the pump 80. This avoids the need for a separate line or umbilical to transmit power to the pump 80. It is assumed, however, that some form of hydraulic or electrical umbilical will be used to control the operation of the isolation valves. The preferred fluid for powering the pump 80 is seawater since it is readily available at no cost and can be exhausted to the sea without polluting.

The pump 80 illustrated in FIG. 5 is a venturi or jet pump. This type of hydraulic-powered pump 80 is preferred since it has no moving parts and is very rugged and reliable. Its principal drawback is that it is less energy efficient (e.g., 33%) than most other types of pumps. The following example illustrates the determination of the power and pressure requirements for a jet pump 80 evacuating the riser while running the 9⅝ in. casing string 66 illustrated in FIG. 3. All values are determined at the end of the evacuation operation when the pump power and pressure are maximum:

- Required seawater evacuation rate: 150 gpm (to keep pace with average casing running speed of about 1200 ft/hr)
- Required power fluid rate: 75 gpm (typically ½ pump rate)
- Maximum pump output hydraulic horsepower: 130 hhp (at maximum evacuation depth of 3,295 feet)
- Maximum required pump input hydraulic horsepower: 390 hhp (for 33% efficiency)
- Maximum power fluid pressure drop across pump: 8,900 psi This example indicates the need for a pump (not illustrated) at the surface that can provide 75 gpm of seawater through the choke line 84 at about 10,000 psi. This is well within the capability of typical cementing pumps that will be readily available during casing installation operations. The pressure is also within the typical 10,000-psi or 15,000-psi rating of choke and kill lines and associated piping.

In a preferred embodiment, the pump 80, suction connection 82, choke line connection 84 and associated piping and valves would be located on a single joint of riser 10 pipe. This joint may be either a full-length (50 or 75 foot) joint or a shorter "pup" joint. The operation of the pump 80 may be controlled manually or automatically. In either case, the controlled variable will be the riser 10 base pressure ($p_{rb}$). As casing 66 is run into the well and mud 67 in the well is displaced into the riser 10, the riser 10 base pressure ($p_{rb}$) Will tend to increase. This will initiate operation of the evacuation pump 80 to return the riser 10 base pressure ($p_{rb}$) to its desired value, approximately equal to ambient seawater pressure at the base of the drilling riser 10.

A pressure sensor 90 can be used to monitor the volume of seawater 68 in the riser 10 as it is evacuated to maintain the riser base pressure ($p_{rb}$) approximately equal to the surrounding seawater 97 pressure at the base of the riser 10. Knowledge of the density of the mud 67 being displaced from the well into the riser 10 and the geometry of the annulus between the riser 10 and the casing 66 and running string 76 will allow conversion of the volume of remaining seawater in the riser 10 into the volume of mud displaced from the well. This displaced volume is an important well control parameter since it must match the volume of well casing 66 being inserted into the well. If it does not, it is an indicator that mud is being lost to the formation or that formation fluids are flowing into the well. Alternatively, the volume of seawater evacuated from the riser 10 may be directly measured using a flow meter (not shown) and converted into the volume of mud displaced from the well.

By monitoring the riser 10 base pressure ($p_{rb}$) during casing 66 installation and adjusting the height of seawater 68 in the riser 10 to compensate for increases in riser 10 base pressure ($p_{rb}$) (arising from displacement of drilling fluid from the well by the casing 66) the pressure at the base of the gas-lifted riser 10 can be maintained at a pressure substantially equal to ambient seawater pressure ($p_{sw}$). This method allows for deeper offshore wells to be drilled using less casing which in turn results in shorter times and lower costs to drill the wells.

The foregoing description has been directed to particular embodiments of the invention for the purpose of illustrating the invention. It will be apparent to persons skilled in the art, however, that many modifications and variations to the embodiments described herein are possible. All such modifications and variations are intended to be within the scope of the present invention, as defined by the appended claims.

What is claimed is:

1. A method for installing a well casing through a drilling riser into a subsea well being drilled with a dual density drilling system, said drilling riser initially containing seawater and extending from above the surface of the body of seawater downwardly to a subsea wellhead, said method comprising the steps of:

lowering said well casing through said drilling riser to said subsea wellhead and allowing displaced seawater to flow out of said drilling riser;

lowering said well casing through said subsea wellhead into said well and allowing displaced drilling fluid to flow upwardly into said drilling riser;

monitoring the riser base pressure as said well casing is lowered into said well; and evacuating the seawater from said drilling riser to compensate for increases in riser base pressure due to said displaced drilling fluid so as to maintain said riser base pressure approximately equal to seawater pressure at the base of said drilling riser.

2. The method of claim 1 wherein the height of seawater ($h_{sw}$) remaining in said drilling riser following evacuation is determined with the equation, where ($h_{sw}$)=seawater depth to the riser base (D)−{[Density of the drilling fluid displaced from said well ($\rho_m$)÷Density of seawater ($\rho_{sw}$)]×Height of column of the drilling fluid displaced from said well ($h_m$)}.

3. The method of claim 1 wherein said seawater is evacuated in said drilling riser using an underwater pump.

4. A method for controlling the pressure at the base of a drilling riser in a dual-density system, used in drilling a subsea well, during casing installation wherein said riser is initially substantially filled with seawater, said method comprising the steps of:

monitoring the riser base pressure during casing installation; and adjusting the height of seawater in said riser to compensate for increases in said riser base pressure in response to the displacement of drilling fluid; thereby maintaining said riser base pressure substantially equal to seawater pressure at the base of said drilling riser throughout the casing installation.

5. The method of claim 4 wherein the height of seawater in said riser is adjusted such that the height ($h_{sw}$) remaining in said drilling riser following evacuation is determined according by the following equation, where ($h_{sw}$)=seawater depth to the riser base (D)−{[Density of the drilling fluid displaced from said well ($\rho_m$)÷Density of seawater ($\rho_{sw}$)]×Height of column of the drilling fluid displaced from said well ($h_m$)}.

6. The method of claim 4 wherein said height of seawater in said drilling riser is adjusted using an underwater pump.

7. A method for maintaining the pressure at the base of a gas-lifted drilling riser, used in drilling a subsea well with drilling fluid, substantially equivalent to ambient seawater pressure at the base of said drilling riser during casing installation; wherein said gas-lifted drilling riser is initially substantially filled with seawater; said method comprising the steps of:

determining the riser base pressure while said casing is displacing said drilling fluid, located in the subsea well, into said drilling riser; and evacuating the seawater from said riser in response to said drilling fluid displacement until said riser base pressure is maintained throughout the casing installation at the pressure of seawater at the base of said drilling riser.

8. The method of claim 7 wherein the height of seawater ($h_{sw}$) remaining in said drilling riser following evacuation is determined according to the following equation: wherein:

($h_{sw}$)=seawater depth to the riser base (D)−{[Density of the drilling fluid displaced from said well ($\rho_m$)÷Density of seawater ($\rho_{sw}$)]×Height of column of the drilling fluid displaced from said well ($h_m$)}.

9. The method of claim 8 wherein said seawater is evacuated from said drilling riser using an underwater pump.

10. A method for installing a well casing into a subsea well being drilled with a gas-lifted drilling riser, said gas-lifted drilling riser containing drilling fluid and lift gas and extending from above the surface of the body of seawater downwardly to a subsea wellhead, said method comprising the steps of:

terminating gas-lifting;

removing said drilling fluid from said drilling riser and replacing said drilling fluid with seawater;

lowering said well casing through said drilling riser to said subsea wellhead and allowing displaced seawater to flow out of the top of said drilling riser;

lowering said well casing through said subsea wellhead into said well and allowing displaced drilling fluid to flow upwardly into said drilling riser;

monitoring the riser base pressure as said well casing is lowered into said well; and evacuating the seawater from said drilling riser to compensate for increases in the riser base pressure due to said displaced drilling fluid so as to maintain said riser base pressure approximately equal to seawater pressure at the base of said drilling riser.

11. The method of claim 10 wherein said step of removing said drilling fluid from said drilling riser further comprises pumping seawater into the base of said drilling riser until said drilling fluid is displaced from said riser.

12. The method of claim 11 further comprising the step of pumping a viscous spacer fluid into the base of said drilling riser prior to pumping seawater into said drilling riser.

13. The method of claim 10 wherein the height of seawater ($h_{sw}$) remaining in said drilling riser following evacuation is determined with the equation, where ($h_{sw}$)=seawater depth to the riser base (D)−{[Density of the drilling fluid displaced from said well ($\rho_m$)÷Density of seawater ($\rho_{sw}$)]×Height of column of the drilling fluid displaced from said well ($h_m$)}.

14. The method of claim 10 wherein said seawater is evacuated in said drilling riser using an underwater pump.

* * * * *